US008671730B2

(12) United States Patent
Ytsma

(10) Patent No.: US 8,671,730 B2
(45) Date of Patent: Mar. 18, 2014

(54) METHOD AND APPARATUS FOR MAKING A CAN WITH A CURLED END, SUCH CAN AND BODY

(75) Inventor: Sybren Ytsma, Friesland (NL)

(73) Assignee: Impress Group B.V., Deventer (NL)

( * ) Notice: Subject to any disclaimer, the term of this patent is extended or adjusted under 35 U.S.C. 154(b) by 0 days.

(21) Appl. No.: 13/521,375

(22) PCT Filed: Jan. 13, 2011

(86) PCT No.: PCT/EP2011/050391

§ 371 (c)(1),
(2), (4) Date: Jul. 10, 2012

(87) PCT Pub. No.: WO2011/086123

PCT Pub. Date: Jul. 21, 2011

(65) Prior Publication Data

US 2013/0140318 A1 Jun. 6, 2013

(30) Foreign Application Priority Data

Jan. 14, 2010 (EP) ..... 10075021

(51) Int. Cl.
*B21D 22/30* (2006.01)
*B21D 51/38* (2006.01)
*B65D 1/16* (2006.01)

(52) U.S. Cl.
CPC ..... *B21D 22/30* (2013.01); *B21D 51/38* (2013.01); *B65D 1/165* (2013.01)
USPC ..... 72/348; 220/669

(58) Field of Classification Search
CPC ..... B65D 1/165; B65D 1/16; B21D 22/30; B21D 22/20; B21D 22/26; B21D 51/38
USPC ..... 220/669, 641, 640, 906, 639, 660
See application file for complete search history.

(56) References Cited

U.S. PATENT DOCUMENTS

| | | | | |
|---|---|---|---|---|
| 746,843 | A | 12/1903 | Jones | |
| 3,029,507 | A * | 4/1962 | Gaggini | 72/254 |
| 3,065,677 | A | 11/1962 | Loeser | |
| 3,818,850 | A * | 6/1974 | Berthet | 72/348 |
| 4,177,746 | A * | 12/1979 | Lee et al. | 413/8 |
| 4,261,193 | A | 4/1981 | Boik | |
| 4,742,932 | A | 5/1988 | Pedragosa | |
| 4,880,131 | A | 11/1989 | Gallagher et al. | |
| 6,442,991 | B1 | 9/2002 | Rojek | |
| 2005/0250637 | A1 | 11/2005 | Messerschmid et al. | |

FOREIGN PATENT DOCUMENTS

| | | | |
|---|---|---|---|
| DE | 3041001 | A1 | 5/1982 |
| DE | 3422040 | A1 | 12/1985 |
| DE | 10040173 | A1 | 5/2001 |
| EP | 0428190 | A1 | 5/1991 |
| EP | 1184103 | A2 | 3/2002 |
| FR | 2559454 | A1 | 8/1985 |
| WO | 2009130034 | A1 | 10/2009 |

OTHER PUBLICATIONS

Translation of EP 428190 (Gallagher ), Nov. 10, 1988.*

* cited by examiner

*Primary Examiner* — Robert J Hicks
(74) *Attorney, Agent, or Firm* — The Webb Law Firm

(57) ABSTRACT

A method and apparatus for making a can, such as a paint can, includes the steps of: i. providing a cylindrical body; ii. arranging a piston in a first opening of the cylindrical body for defining the diameter of the opening; and iii. curling a free end of the first opening radially outwardly and axially along the cylindrical body thereby forming a curl.

15 Claims, 10 Drawing Sheets

METHOD AND APPARATUS FOR MAKING A CAN WITH A CURLED END, SUCH CAN AND BODY

BACKGROUND OF THE INVENTION

1) Field of the Invention

The present invention relates to a method for making a can such as a paint can, to an apparatus for making a can and to such can and can body.

2) Prior Art

Cans such as paint can, are generally provided with ring which is adhered to the can body such as by seaming, welding or gluing. This ring has an opening with a diameter which is selected such that a lid for such can will be accommodated in the ring opening with a well defined clamping force. This clamping force is selected such that under normal handling conditions the lid will stay on the can and the can content not spoiled. At the same time the clamping force is such that the user is able to remove the lid from the can without application of excessive force and without damaging the can, particularly when a tool such as a screw driver, is used for removing the lid. These characteristics for the lid generally require that the ring is made in a separate process and apparatus such that the delicate form and shape can be maintained and controlled independently from the process and apparatus for making the can body. Ultimately, the separate ring is adhered to the can body thereby forming the can.

Obviously, the separate production of such rings from a sheet of metal results in a relatively large amount of spoiled material formed when cutting out the central area thereby forming the ring opening. In addition, an additional operational step is required for adhering the ring to the can body.

When under circumstances the clamping of the lid on the can body by the ring cannot be guaranteed then an separate clamping band or strip is to applied to the upper area of the can in order to generate additional clamping force. The use of such clamping band or strip is costs increasing and after its removal the clamping force is no longer optimal.

The present invention has for its object to provide a can which substantially overcomes the above mentioned drawbacks and still a lid can be applied to the can body and maintained with adequate clamping force without the need of a separate adhered ring and/or clamping band or strip. At the same time the lid can be removed by the user in the usual manner without exerting excessive force.

SUMMARY OF THE INVENTION

In order to solve this problem the invention provided according to a first aspect of the invention a method for making can, such as a paint can, comprising the steps of:

i. providing a cylindrical body;

ii. arranging piston means in a first opening of the cylindrical body for defining the diameter of the opening;

iii. curling a free end of the first opening radially outwardly and axially along the cylindrical body thereby forming a curl, such that the defined diameter of the first opening is substantially circumferentially, dimensionally stable.

These method of the present invention is able to avoid the use of a separate clamping ring because the opening of the can body into which the lid is to be accommodated with the required clamping force has a sufficient radial strength and circumferential dimensional stability because of the formed curl and the presence in the opening of piston means dictating and maintaining the defined diameter during the formation of the can body. The curl is radially outwardly curled so that the form stability is maintained and substantial variation in contour and wall thickness is avoided.

An advantage of the can body provided with such integral outwardly curled clamping curl is that the inner surface is smooth and continuous so that content of the can is able to be released without any material remaining in inner grooves or slots at the connection between the can body and the ring.

According to a preferred embodiment, is the free end of the first opening of the can body is provided with a precurl prior to the formation of the curl in step iii). Accordingly, the edge of the cylindrical body which is often a sharp cutting edge is protected and hardly exposed thereby avoiding possible corrosion problems.

As stated above, it is required that the curl is formed radially outwardly and axially along the cylindrical body. This implies that the outer diameter of the curl is larger than the outer diameter of the cylindrical body and the ultimate can body.

When it is preferred that the curl is not to extend to a major extent beyond the can body or preferably lies within the confinement of the can body and thus have an outer diameter which is equal or less than the outer diameter of the can body then the curl is to be formed in a portion of the can body having a smaller diameter. Such can body portion with a reduced diameter cannot be formed by necking that portion of the can body because when necking the circumferential dimensional stability and wall thickness cannot sufficiently controlled. Still this objective can be met when according to a preferred embodiment of the invention the cylindrical body is partly radially stretched up to the first free end, such that the curl is formed in an unstretched necked portion of the otherwise stretched cylindrical body, and preferably the curl lies within the outer imaginary envelope of the radially stretched cylindrical body part. Thus, the necked portion of the cylindrical body is formed by increasing the diameter of the other part of the cylindrical body and thus not manipulating the free end of the opening which has due the presence of the piston means the desired defined diameter and remains free end untouched.

The formation of the radially stretched cylindrical body can be accomplished by any suitable technique such as rolling, stretching, (deep) drawing and ironing. Preferred is formation by radially outward stretching because this results in a stretched can body which is having a substantially constant wall thickness and allows stretching up to 20 to 25% providing additional material savings. Such stretching operation is for instance disclosed in WO2009/130034. In order to have this stretching operation be carried out in a controlled and elegant manner, it is preferred that a second opening of the cylindrical body is provided with a tromped mouth and the radially stretching is carried out with the stretching means via the tromped mouth up to, but not inclusive, the free end of the second opening. In doing so, the stretching means may be provided piston means required for defining and maintaining the defined diameter of the opening, and extending into this free end.

When the dimensions of the tromped mouth are such that the tromping angle with the cylindrical body lies within the range of 5° and 40°, such as between 10° and 30° then the tromped mouth and the precurl can be formed in one and the same operation and thus in the same apparatus unit or station. For reasons, that the axial force for forming the curl at one end of the cylindrical body is less than the axial force required for forming the tromped mouth at the other free end. However, dependent on the type of metal of the cylindrical body, its wall thickness, and the form of the tromping tool it is also possible to first form the tromped mouth and subsequently, the precurl.

Under circumstances both the tromped mouth and the precurl may be formed substantially at the same time.

In order to radially stretch the cylindrical body in a controlled and reliable manner it is preferred that the cylindrical body is firmly held by clamping means. Thereto the cylindrical body is to be provided with a clamping flange. Thus, according to a preferred embodiment of the invention, prior to the radially stretching of the cylindrical body, the free end of the second opening is provided with a clamping flange for clamping with clamping means the cylindrical body during radially stretching.

This stretching while being clamped will not result in the formation of wavy structures in the cylindrical body, which are the result of axial resistance to the stretching, when the first opening of the cylindrical body which is remote of the tromped mouth is not supported. This can be accomplished by maintaining the distance between an apparatus support on which the cylindrical body rests and the support of the clamping means because the radial stretching will result in a reduction in length of the cylindrical body. The cylindrical body will be lifted, when suspended and clamped by the clamping means.

If it is preferred that the filled and closed can is easily handled and carried, particularly for cans with larger volumes then according to the invention handle means may be encaged in the curl during the curl formation. Such handle means may have the form of flexible strips or bands made from plastic or metal. They are elegantly incorporated in the curl during the curl formation. An additional advantage is that these handle means do not substantially extend beyond the confinement of the can and are thus easy to handle and stacked and stored at small surface areas.

The circumferential dimensional stability of the curled opening of the can which is obtained by the use of the diameter determining piston means lodged in the opening during the can making, is substantially equal for all diameters of the can. As an example the dimensional stability for can diameters of 32 mm to 300 mm, such as 48 mm to 286 mm, in particular 57 mm to 165 mm has a margin of error of ±0.10 mm or less. Preferably the margin of error for the dimensional stability is ±0.05 mm, and more preferably ±0.03 mm. This dimensional stability with such margin of error is such that for can with these diameters the clamping force is sufficient for a reliable fixation of the lid on the can without the need of a clamping ring and/or clamping band or strip.

Another aspect of the invention relates to apparatus for making the can according to the invention. This apparatus comprising piston means to be arranged in a first opening of a cylindrical body for maintaining the defined diameter of the opening substantially dimensionally stable, and curling means for forming a curl by radially outwardly and axially along the cylindrical body curling the free end of the first opening. In a practical embodiment comprises the apparatus a unit for arranging piston means in the opening and curling means for forming the curl.

For increasing the strength of the free end of the first opening and for avoiding exposure of the often sharp free end, it is preferred that the apparatus comprises means for precurling the free end of the first opening prior to the formation of the curl.

In order to arrange the curled free end in a necked portion of the can it is preferred according to the invention that another part of the can is radially stretched. Thereto it is preferred that the apparatus comprises stretching means for radially stretching the cylindrical body up to a first free end of the first opening, and preferably piston means are incorporated in the stretching means.

The radial stretching is elegantly controlled if preferably the apparatus comprises means for tromping a second opening of the cylindrical body.

The radial force for forming the tromping the second opening may be larger, smaller or equal to the radial force for forming the precurl so that one is made after the other or substantially at the same time. According to the invention the tromping means and the means for forming the precurl may be arranged in the same unit of the apparatus, thereby reducing the number of units and the time for making the can.

In order to properly control the radial stretching of the cylindrical body at the preferably tromped mouth it is recommended the provide the free end with a clamping flange. Thereto, the apparatus of the invention preferably comprises means for forming a clamping flange on the free end of the second opening, and means for clamping the cylindrical body during radially stretching. Such radial stretching can then be carried out with the remote opening of the cylindrical body not support, so that a counter axial force is substantially avoided. This results in an improved uniformity of the body wall thickness. It is preferred according to the invention that the means for forming the clamping flange and the means for forming the curl are incorporated in the same apparatus unit.

It is also preferred that the apparatus according to the invention comprises means for encaging handle means in the curl.

Finally, a third aspect of the invention relates to a can and a can body therefore. The can may be a paint can or food can, and is obtainable by the method of the invention as described above. This can having a clamped lid, is characterized by a free end provided with a curl which is integral with a can body, and which defines a can opening having accommodated the lid, and which opening is substantially dimensionally stable, preferably having a dimensional stability with a margin of error of ±0.10 mm, preferably ±0.05 mm, more preferably ±0.03 mm. The can body for the can of the invention is characterized by a first opening having a necked free end provided with a curl defining a substantially dimensionally stable opening, and preferably a second opening having a clamping flange.

BRIEF DESCRIPTION OF THE DRAWINGS

Mentioned and other features of the method and apparatus for making a can and can body of the present invention and of the can and can body as such will be further illustrated by several embodiments which are given for information purposes only and are not intended to limit the invention to any extent. In relation to these embodiments reference will be made to the annexed figures of which.

DETAILED DESCRIPTION OF THE PREFERRED EMBODIMENTS

Figure 1A:
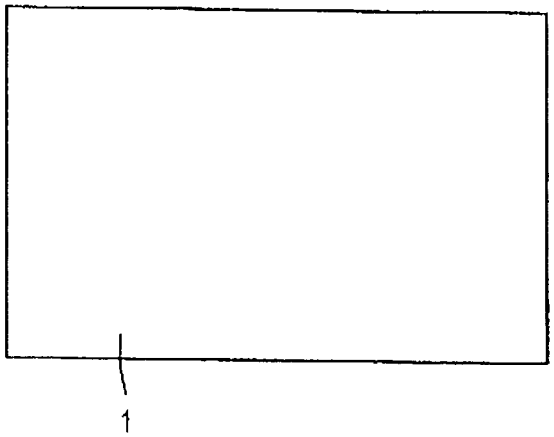
FIG. 1A is a plan view of a metal sheet for making a cylindrical body.
Figure 1B:
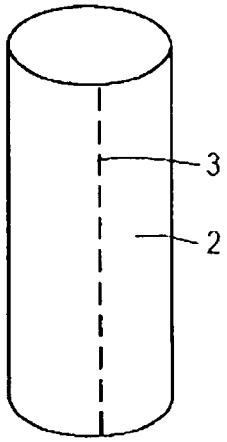
FIG. 1B is a perspective view of a cylindrical body formed from the metal sheet of FIG. 1A.

FIG. 1A shows a sheet 1 of metal, such as steel, tin plate, aluminium and the like. The sheet has a wall thickness of about 0.12 to 2 mm dependent on the metal and the operation of forming a can of the invention. The sheet 1 is formed into a cylindrical body 2 and provided with a weld seam 3.

FIG. 2A-2F show a first unit 4 of the apparatus of the invention for forming the tromped mouth 5 at the second free end 6 on the cylindrical body 2, and for forming a precurl 7 on the first free end 8 on the cylindrical body 2. Thereto the unit 4 comprises a tromping tool 16 having an entry section 9, a first diverging section 10 with a moderate diverging angle in the range of about 5° to about 15°, and a second diverging section 11 having a larger diverging angle in the range of about 15° to about 35°.

The cylindrical body 2 is mounted at the free end 6 on the entry section 9 of the tromping tool 16. Subsequently, a pusher tool 12 pushes along the arrow 13 the cylindrical body over the diverging sections 10 and 11, thereby forming the tromped mouth 5 (see FIG. 2B).

Figure 2A:
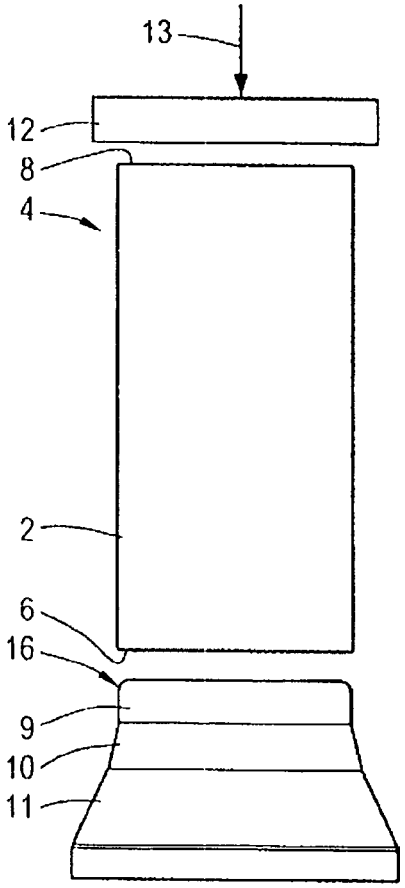
FIGS. 2A to 2F show schematically the various stages for forming the tromped mouth and the precurl.
Figure 2B:
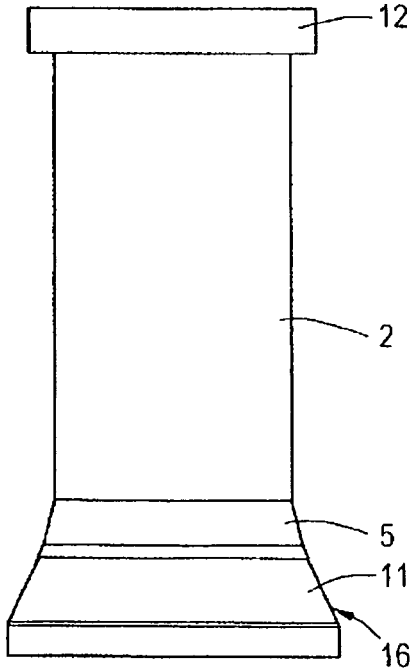
Figure 2C:
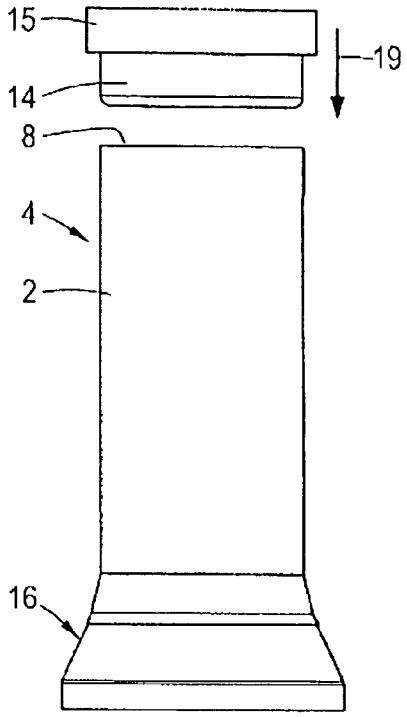
Figure 2D:
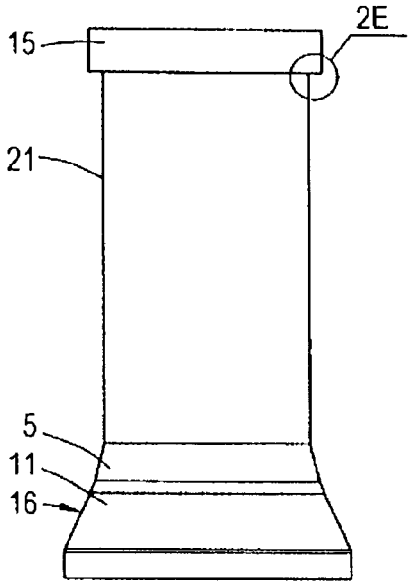
Figure 2E:
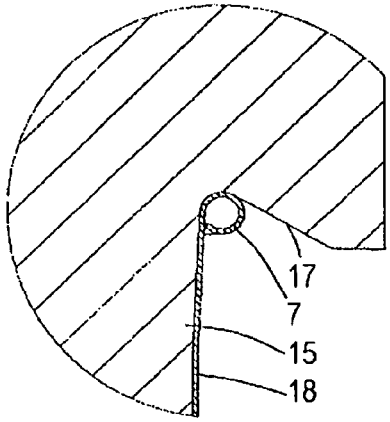
Figure 2F:
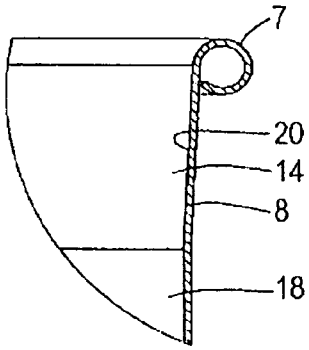

Thereafter, the pusher tool 12 is retracted and a piston means 14 is arranged in the first free end 8 thereby defining and controlling the defined diameter of the first free end 8 during structuring thereof (see FIG. 2C). The piston means 14 are mounted on a forming tool 15. This forming tool 15 comprises a forming cavity 17 designed such that by the downward movement according to arrow 19 the precurl 7 is formed in the body wall 18 with the piston means 14 in the defined opening 20 (see FIGS. 2D and 2E). The axial downward force for forming the precurl 7 is less than the force required for forming the tromped mouth 5. Thus the cylindrical body 2 mounted on the tromping tool 16 is substantially maintained in its original position. Accordingly, ultimately is formed in the unit 4 a cylindrical body 21 having at the first free end 8 the first opening 20 defined by the piston means 14 and the precurl 7, and further at the second free end 6 the tromped mouth 5 (see FIG. 2F). As indicated before dependent on for instance the material of the cylindrical body, its wall thickness, and the form of the tromping tool 16 the forming of the tromped mouth and the precurl may be in different order or at substantially the same time.

Figure 3A:
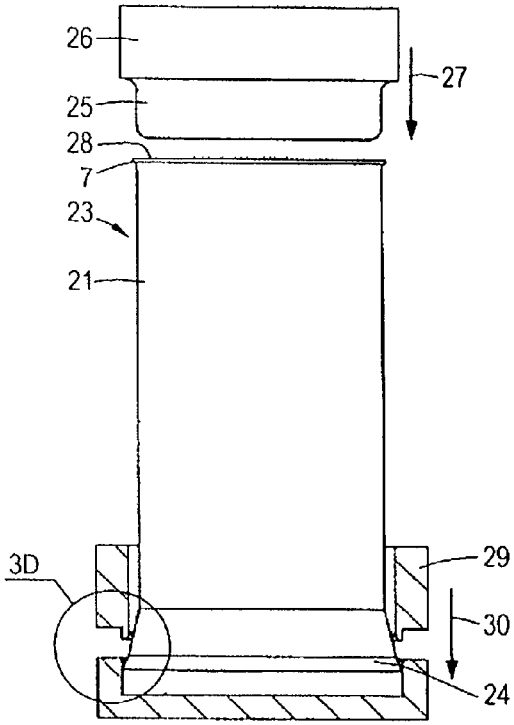
FIGS. 3A to 3E show schematically the various stages for forming part of the curl and of the clamping flange.
Figure 3D:
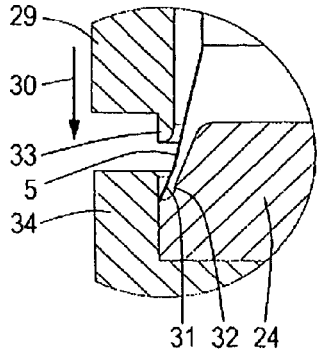
Figure 3E:
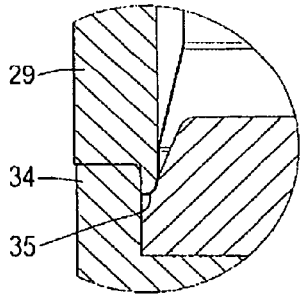
Figure 3B:
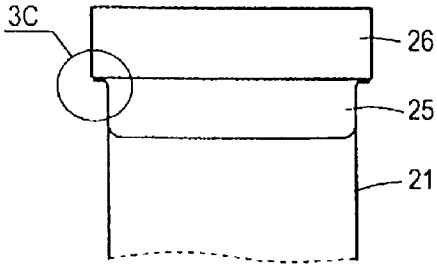
Figure 3C:
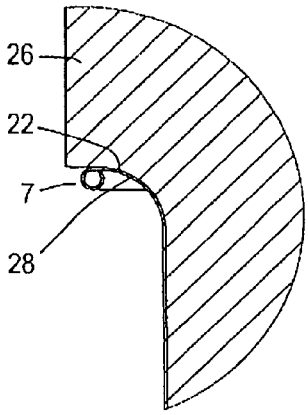

In the unit 23 of the apparatus of the invention the cylindrical body produced in the apparatus unit 4 is mounted on a support 24 (see FIG. 3A). Piston means 25 mounted on forming tool 26 are mounted in the defined first opening 20 provided with the precurl 7. Movement following arrow 27 will result in the formation of a curl part 22 in a forming cavity 28 of the forming tool 26. This curl part 22 carries the precurl 7 (see FIGS. 3B and 3C). Thereafter, the forming tool 29 is axially moved following arrow 30 towards a free edge 31 of the tromped mouth 7 residing in a forming cavity 32. This forming cavity 32 is formed between the support 24 and the tool 34. A forming edge 33 of the forming tool 29 contacts the free edge 31 and forms a clamping flange 35 at the tromped mouth 5 (see FIGS. 3D and 3E). In this manner is formed a cylindrical body 36 having a tromped mouth 5 provided with the clamping flange 35 and a first opening 20 of the defined diameter and provided with a curl part 22 and the precurl 7.

Figure 4A:
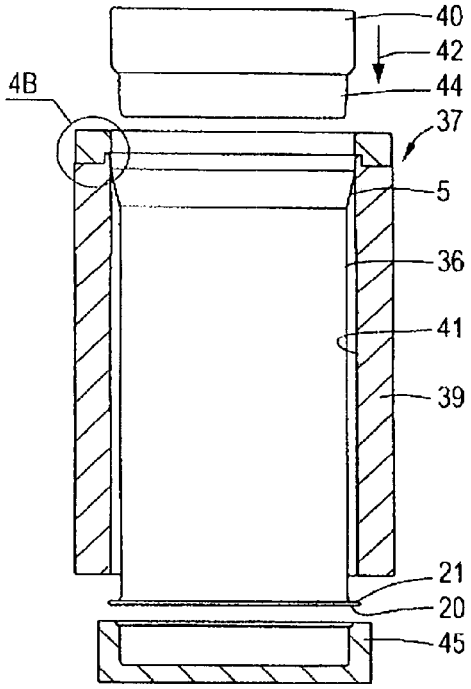
FIGS. 4A to 4C show schematically the clamping and radial stretching of the cylindrical body.
Figure 4B:
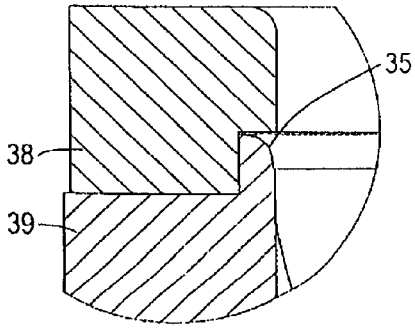
Figure 4C:
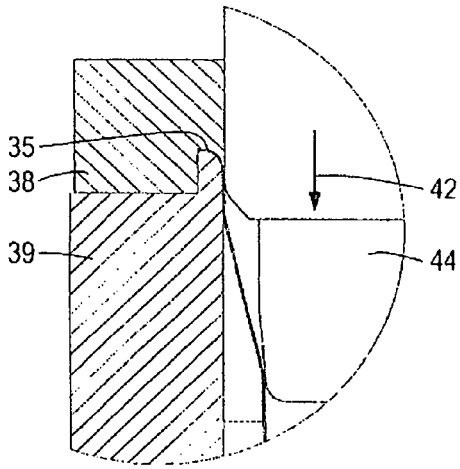

This cylindrical body 36 is turned upside down (in comparison to FIG. 3B) and suspended in clamping arrangement by the clamping means 37. These clamping means 37 comprise the clamping tools 38 and 39. A stretching tool 40 is passed through the tromped mouth 5 and on passing through the clamping tool 40 following arrow 42 stretches radially outwardly the cylindrical body 36 over the outer surface of the stretching tool 40. This results in a reduction of the length of the cylindrical body 36 (see FIGS. 4A-4C). A substantial part of the cylindrical body 36 is radially outwardly stretched. The remaining unstretched part of the cylindrical body now forms the necked portion 43 defined by the piston means 44 mounted on the stretching tool 40 (see FIGS. 4A and 5A).

Figure 5A:
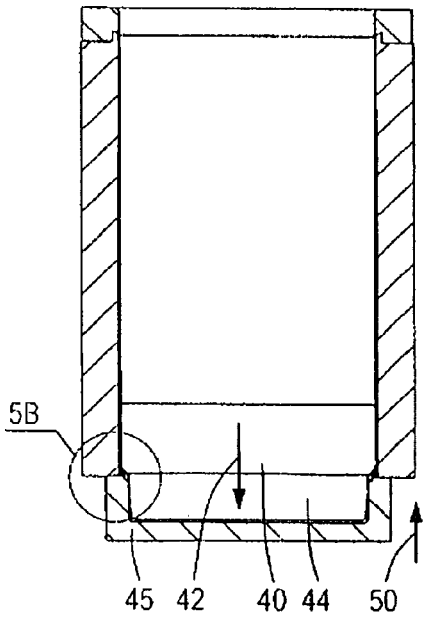
FIGS. 5A to 5C show schematically formation of the curl in the necked portion of the cylindrical body.
Figure 5B:
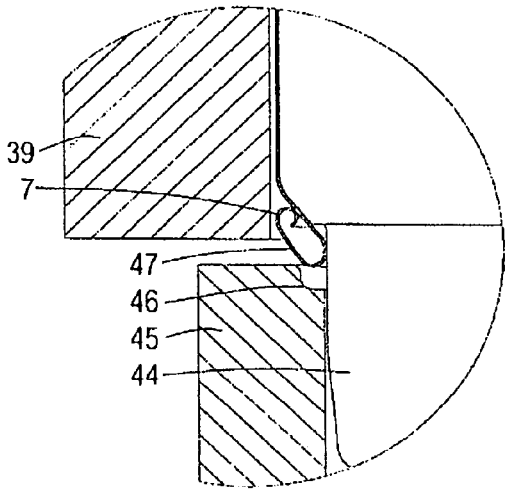
Figure 5C:
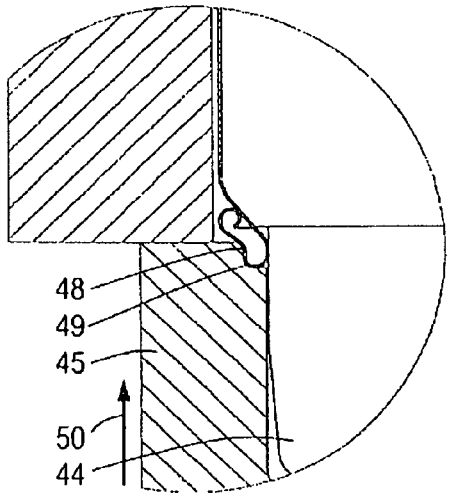
Figure 6A:
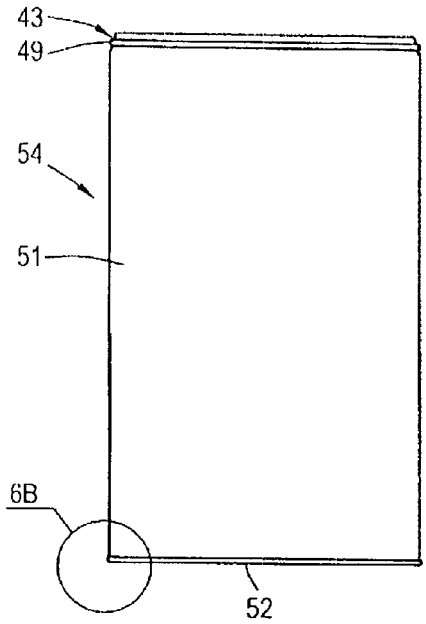
FIGS. 6A and 6B show schematically the application of a bottom to the cylindrical body.
Figure 6B:
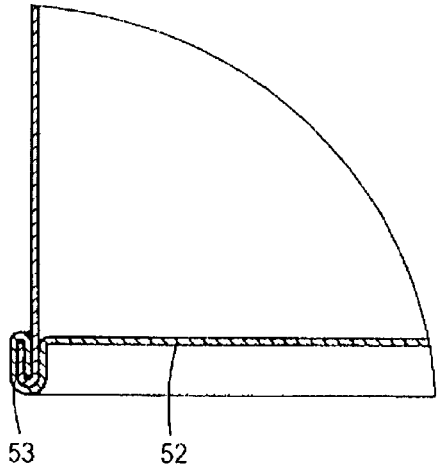

As shown in FIGS. 5A-5C, a forming tool 45 is moved upwardly following arrow 50. This forming tool 45 comprises a forming cavity 46 which first forms an elongated curl 47 having the precurl 7 along the cylindrical body in the necked portion 43. The elongated curl 47 is formed along the piston means 44 which defined the diameter of the first opening now provided with the elongated curl 47. Ultimately, following the movement of arrow 50 the forming cavity which encloses part of the elongated curl 47 forms the step 48. The result is the formation of an elongated and stepped curl 49. The cylindrical body 51 having the elongated stepped curl 49 in the necked portion 43 is provided with a bottom 52 via a seam connection 53. This results in a can body 54 according to the invention (see FIGS. 6A and 6B).

Figure 7B:
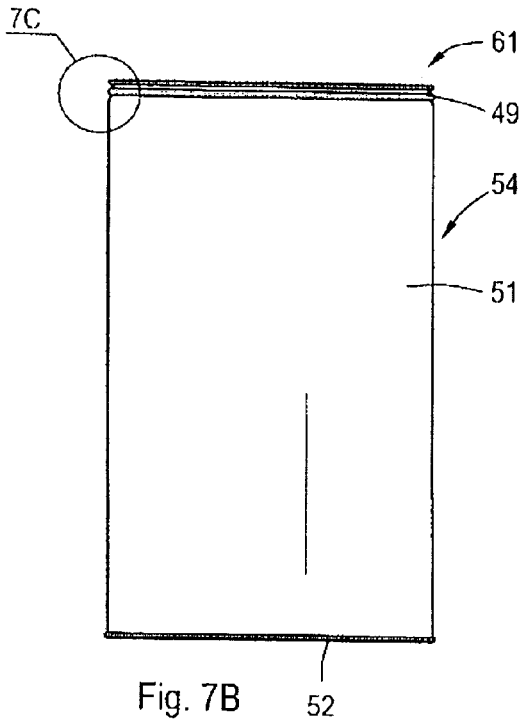
FIGS. 7A to 7C show schematically the mounting and removal of the lid.
Figure 7A:
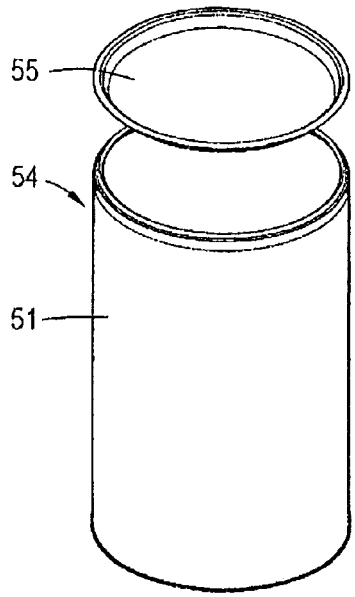
Figure 7C:
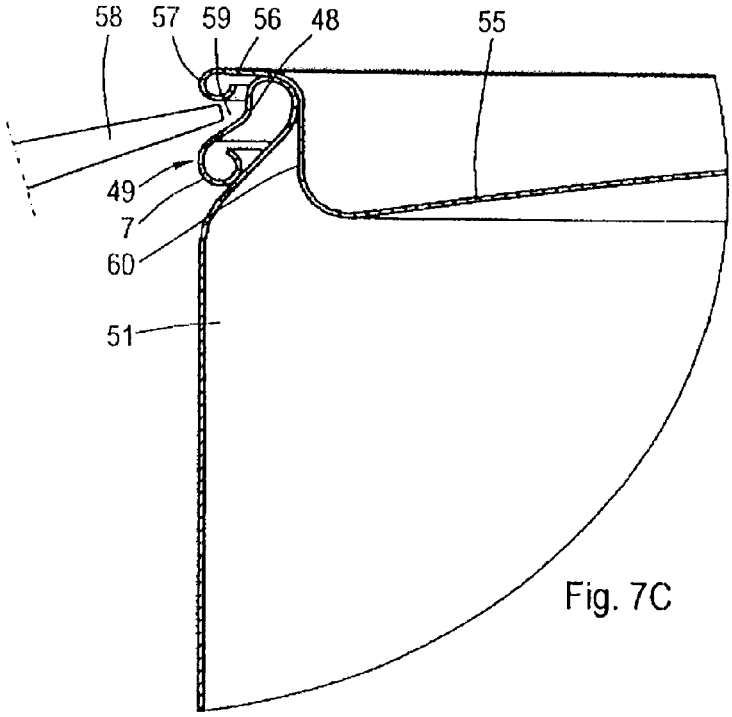

The can body 54 can be provided with a lid 55 of which an annular lid part 56 rests on the elongated curl 49 and a lid curl 57 extends radially over the step 48 in the elongated curl 49 (see FIGS. 7A to 7C). This forms an access 59 for a tool 58 by which the lid 55 can be removed from the cylindrical body 51 of the can 61 of the invention. The opening 60 defined by the elongated curl 49 corresponds to the diameter of the piston means 44 and has a dimension stability with a margin of error of 0.03 mm. The lid 55 is clamped with a clamping force in the opening 60 that the closed can of the invention can be used as for instance a paint can. The clamping force is generated by the form of the elongated and stepped curl 49.

Figure 8A:
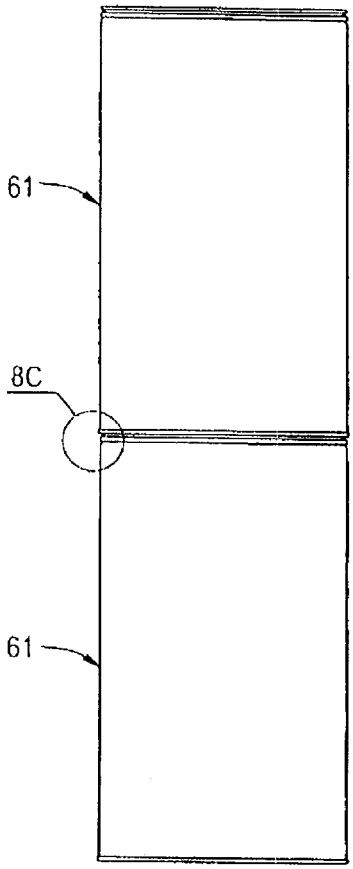
FIGS. 8A and 8B show schematically the stacking of the can of the invention closed with a lid.
Figure 8B:
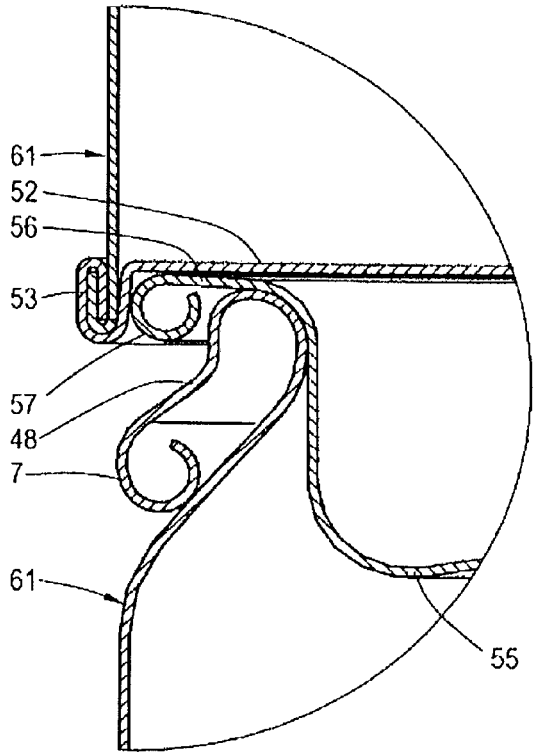
Figure 9A:
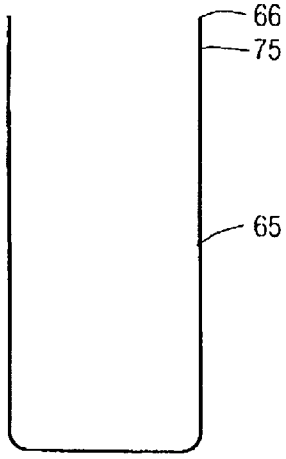
FIGS. 9A to 9F show another embodiment of the can of the invention having an integral bottom.
Figure 9B:
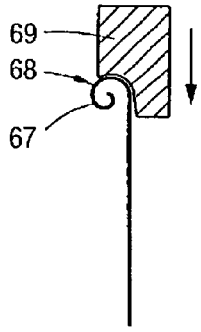
Figure 9C:
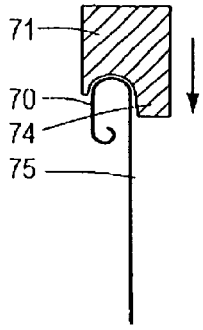
Figure 9D:
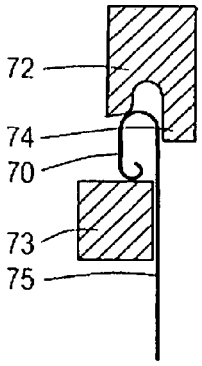
Figure 9E:
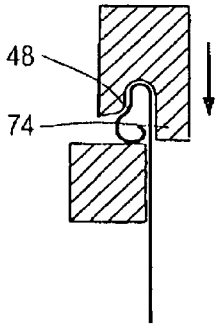
Figure 9F:
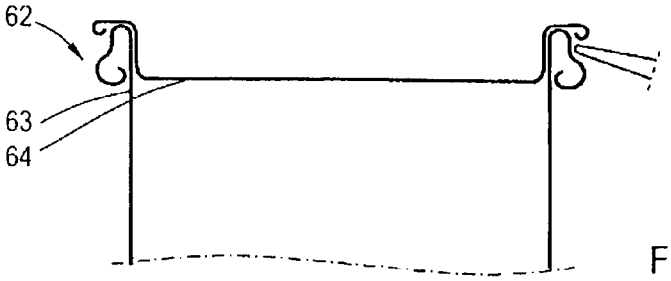

FIGS. 8A and 8B show two stacked cans 61 of the invention. The bottom of the upper can 61 rests with the bottom on the annular lid part 56 of the lid 55 of the lower can 61. The seam connection 53 extends beyond the curl 57 and over closes the curl 57, such that the upper stacked can 61 is locked against a radial displacement.

The can body 54 consists of two pieces, namely the cylindrical body 51 with the integral elongated and stepped curl 49, and the seamed bottom 52. Inclusive the lid 55, the can 61 of the present invention consists of three pieces.

FIGS. 9A to 9F show the making of another can 62 of the invention consisting of two pieces, namely the can body 63 and the lid 64. The can body 63 with an integral bottom is formed from a cylindrical body 65. A free end 66 of the cylindrical body 65 is provided with an elongated curl that may be optionally stepped. Thereto the free end is provided with a precurl 67 as described in relation to FIG. 2E using a forming tool 15 having a precurl forming cavity 17. A curl 68 is formed by using a forming tool 69. This curl 68 is transformed into an elongated curl 70 using a forming tool 71. Optionally, the elongated curl 70 is provided with a step 48 using a forming tool 72 and supporting tool 73. The forming tools 71 and 72 are provided with piston means 74 which are arranged in the opening 75 of the cylindrical body 65 during the formation of the integral curl 70. This means that the can 62 of the invention has a can body 63 with an integral bottom and curl 70 having a defined diameter closely corresponding to the outer diameter of the piston means 74.

Figure 10A:
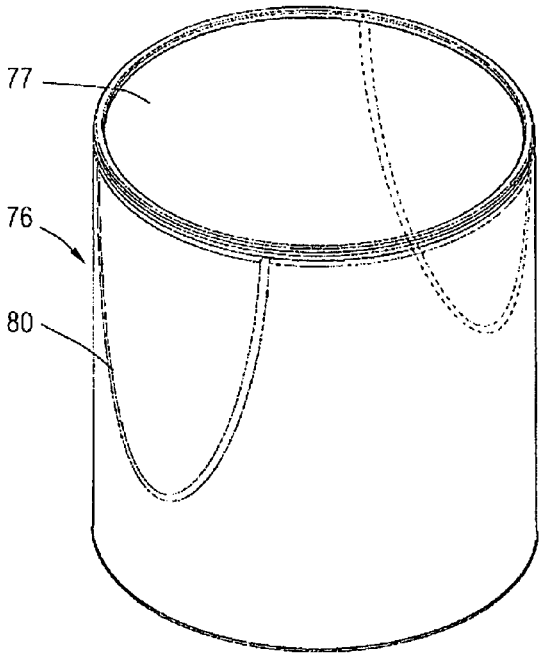
FIGS. 10A to 10C show still another embodiment of a can according to the invention provided with flexible handles.
Figure 10C:
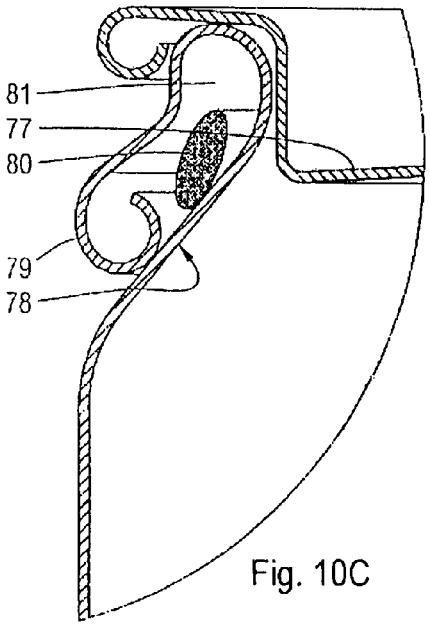
Figure 10B:
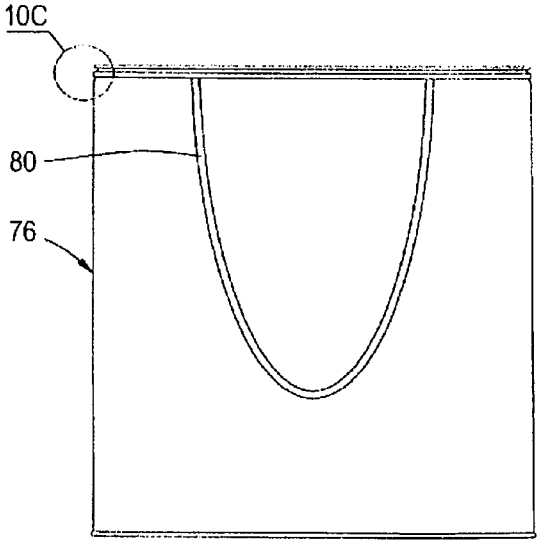

FIGS. 10A to 10C show another embodiment of a can 76 according to the invention. The can 76 comprises a lid 77 are closing in a necked portion 78 an opening provided with an integral curl 79. This defined opening is produced in the same manner as for the above described cans according to the invention. However, during the formation of the integral curl 79 handle means 80 are placed in the necked portion 78 where the integral and elongated curl 79 is to be formed. After formation of the curl 79 the handle means 80 are encaged and tightly fixed to the can 76. These handle means may be used when carrying the can 76 of the invention.

The invention claimed is:

1. A method for making a can comprising the steps of:

i. providing a cylindrical body;

ii. arranging piston means in a first opening of the cylindrical body for defining the diameter of the opening; and iii. curling a free end of the first opening radially outwardly and axially along the cylindrical body thereby forming a curl, wherein the free end of the first opening is provided with a precurl prior to the formation of the curl in step iii), the curling step iii) comprises the forming of the free end of the first opening with the precurl with an elongated curl, a step is formed in the elongated curl, thereby forming an elongated and stepped curl, and the cylindrical body is partly radially stretched up to the free end of the first opening, such that the elongated and stepped curl is formed in a necked portion of the radially stretched cylindrical body, and the elongated and stepped curl lies within an outer imaginary envelope of the radially stretched cylindrical body part.

2. The method as claimed in claim 1, wherein a second opening of the cylindrical body is provided with a tromped mouth and the radially stretching is carried out with a stretching means via the tromped mouth up to the free end of the second opening.

3. The method as claimed in claim 1, wherein prior to the radially stretching of the cylindrical body, the free end of the second opening is provided with a clamping flange for clamping with clamping means the cylindrical body during radially stretching.

4. The method according to claim 1, wherein handle means are encaged in the curl during the curl formation.

5. The method as claimed in claim 1, wherein the defined diameter of the first opening has a dimensional stability with a margin of error of ±0.10 mm or less.

6. An apparatus for making the can according to claim 1, comprising the piston means arranged in the first opening of the cylindrical body for maintaining the defined diameter of the opening substantially dimensionally stable, and curling means for forming the curl by radially outwardly and axially along the cylindrical body curling the free end of the first opening.

7. The apparatus according to claim 6, further comprising means for precurling the free end of the first opening prior to the formation of the curl.

8. The apparatus of claim 6, further comprising stretching means for radially stretching the cylindrical body up to a first free end of the first opening, and means for forming the step in the elongated curl.

9. The apparatus according to claim 6, further comprising means for tromping a second opening of the cylindrical body.

10. The apparatus according to claim 6, further comprising means for forming a clamping flange on the free end of the second opening, and means for clamping the cylindrical body during radially stretching.

11. The apparatus according to claim 6, further comprising means for encaging handle means in the curl.

12. A can comprising a free end provided with a curl provided with a precurl, which is integral with a radially stretched cylindrical body, and which defines a can opening which is substantially dimensionally stable, which curl lies within an outer imaginary envelope of the radially stretched cylindrical body, wherein the precurl of the curl includes an elongated curl provided with a step, and a lid is provided that includes an annular lid portion that rests on the elongated curl and a lid curl that extends radially over the step.

13. A can body, comprising a first opening having a necked free end provided with a curl having a precurl, which is integral with a radially stretched cylindrical body, and which defines a can opening which is substantially dimensionally stable which curl lies within an outer imaginary envelope of the radially stretched cylindrical body, wherein the precurl of the curl includes an elongated curl provided with a step.

14. The apparatus of claim 8, wherein the piston means are incorporated in the stretching means.

15. The can of claim 12, wherein the can has a dimensional stability with a margin of error of ±0.10 mm or less.

* * * * *